US005931301A

United States Patent [19]

Hadden et al.

[11] Patent Number: 5,931,301

[45] Date of Patent: Aug. 3, 1999

[54] CARPET SAMPLE DISPLAY

[75] Inventors: James W. Hadden, LaGrange; Raymond A. Berard, Kennesaw, both of Ga.

[73] Assignee: Interface, Inc., Atlanta, Ga.

[21] Appl. No.: 09/018,033

[22] Filed: Feb. 3, 1998

[51] Int. Cl.[6] ..... B65D 85/48; A47F 7/16

[52] U.S. Cl. ..... 206/449; 211/46

[58] Field of Search ..... 206/450, 451, 206/733, 734, 449, 472; 190/16; 211/45–48, 113

[56] References Cited

U.S. PATENT DOCUMENTS

| | | | |
|---|---|---|---|
| D. 160,830 | 11/1950 | Aro | 211/45 X |
| 244,818 | 7/1881 | McLean . | |
| 958,218 | 5/1910 | Benze . | |
| 1,906,555 | 5/1933 | Donnell . | |
| 1,977,667 | 10/1934 | Breitkrenz | 206/449 |
| 2,126,407 | 8/1938 | Payne et al. . | |
| 2,239,145 | 4/1941 | Doner . | |
| 2,833,457 | 5/1958 | Tyrseck . | |
| 3,138,261 | 6/1964 | Witteborg | 211/45 X |
| 3,185,308 | 5/1965 | Howard | 206/451 X |
| 3,352,415 | 11/1967 | Seeley et al. . | |
| 3,514,875 | 6/1970 | Howard | 206/472 |
| 3,532,412 | 10/1970 | Miller . | |
| 3,620,552 | 11/1971 | Woodcock et al. . | |
| 3,816,948 | 6/1974 | Mooney et al. . | |
| 3,841,548 | 10/1974 | Curley . | |
| 4,063,648 | 12/1977 | Fuller et al. | 211/45 |
| 4,240,761 | 12/1980 | Jacobson . | |
| 4,651,872 | 3/1987 | Joyce . | |
| 4,703,943 | 11/1987 | Zelenko et al. | 206/450 X |
| 4,880,327 | 11/1989 | Sanabria . | |
| 5,259,517 | 11/1993 | Pancoe | 211/46 |
| 5,316,138 | 5/1994 | Thompson | 206/450 X |
| 5,407,076 | 4/1995 | Sabet . | |
| 5,611,433 | 3/1997 | Levy . | |

FOREIGN PATENT DOCUMENTS

| | | |
|---|---|---|
| 725422 | 3/1955 | United Kingdom . |

*Primary Examiner*—Bryon P. Gehman
*Attorney, Agent, or Firm*—Kilpatrick Stockton LLP; John S. Pratt; Michael F. Labbee

[57] ABSTRACT

A carpet swatch holder in accordance with the present invention is constructed from a single sheet of extruded plastic or other suitable material. T-shaped structures or channels protrude from the faces of the sheet. Carpet swatches placed on the sheet so that at least two edges are inserted between the crossbar of the T-shaped structure and the face of the sheet. The channels are spaced at one or more predetermined intervals to allow swatches of any desired size to be inserted into the holder.

12 Claims, 1 Drawing Sheet

CARPET SAMPLE DISPLAY

BACKGROUND OF THE INVENTION

A wide variety of carpet styles are readily available for installation in home and office settings. In order to show prospective buyers these styles, a carpet salesman must carry a large number of carpet swatches to meetings with buyers. Typically, these carpet swatches are held together in a "flip-book," i.e., a number of small squares or rectangles of carpet bound together at one edge, allowing the buyer to flip through the various different styles. Flip-books are bulky and not particularly stable, making the flip-book difficult to use and even more difficult to carry from meeting to meeting.

Carpet sample books have been developed in an effort to address the problems associated with carrying and displaying carpet samples. For instance, U.S. Pat. No. 5,316,138 to Thompson, entitled "Carpet Display Sample Kit," discloses a sample kit comprising a box and a support tray. While Thompson's kit makes it easier to carry a number of carpet samples, it accommodates only a limited number of samples. Moreover, Thompson's kit is relatively complex and requires several parts. This may increase the weight of the kit, making it bulky and difficult to carry. Multi-part construction also increases the cost and complexity of manufacture.

Thus, it is desirable to provide a means for holding carpet swatches which is lightweight, easy to manufacture and capable of carrying and displaying a large number of carpet samples.

SUMMARY OF THE INVENTION

The carpet swatch holder in accordance with the present invention is constructed from a single sheet of plastic or other suitable material from which channels having T-shaped or L-shaped cross sections protrude to form open-faced sleeves into which carpet samples may be slipped. Carpet swatches are inserted by sliding them in from an edge of the sheet between adjacent channels so that two opposing edges of the swatch are inserted between the crossbar of the "T" or "L" and the face of the sheet. The channels are spaced at one or more predetermined intervals to allow swatches of complimentary size to be inserted into the holder.

Accordingly, it is an object of the invention to provide a means for conveniently and attractively displaying numerous carpet swatches in a compact and lightweight package.

Another object of the invention to provide a means for displaying carpet swatches which may be constructed from a single sheet of material.

Another object of the invention to provide a means for displaying carpet swatches which may be easily manufactured.

Other objects, features and advantages of the present invention will become apparent with reference to the drawings, the following description of the drawings and the claims.

DETAILED DESCRIPTION OF THE DRAWINGS

Figure 1:
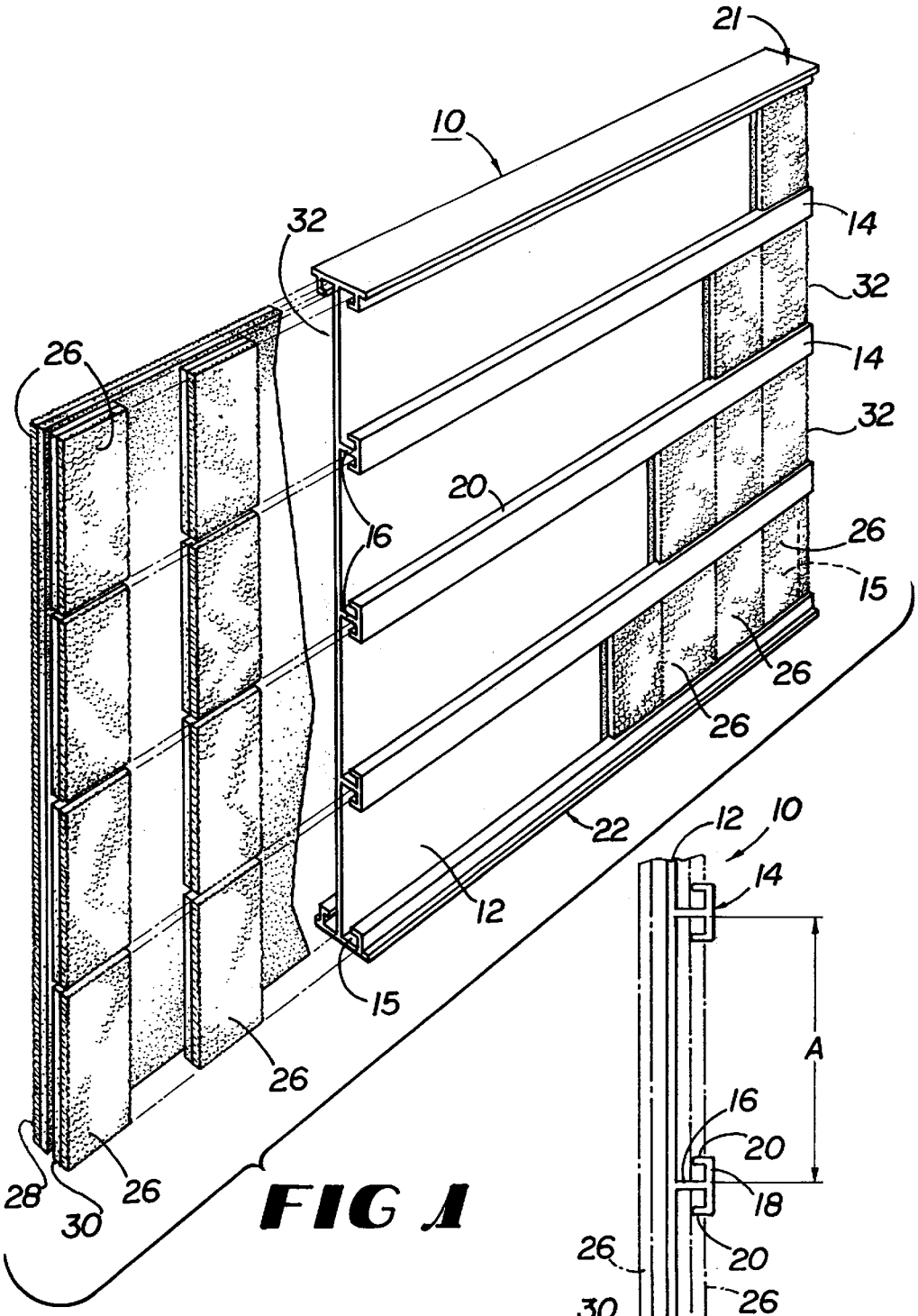
FIG. 1 perspective view the carpet swatch holder in accordance with the present invention.
Figure 2:
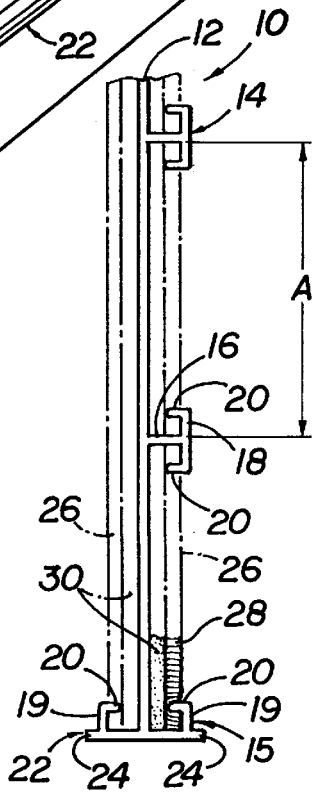
FIG. 2 is a partial edge or end view of the carpet swatch holder of FIG. 1.

The carpet swatch holder of the present invention organizes a large number of carpet samples in an attractive and compact two sided package. FIGS. 1 and 2 show an illustrative embodiment of a Holder 10 in accordance with the present invention. Holder 10 may be constructed as a one-piece structure of a variety of suitable materials, including, but not limited to, plastic and aluminum. Preferably, Holder 10 may be extruded in one piece of aluminum or plastic. Alternatively, it may be assembled from multiple pieces or formed by any other appropriate manufacturing process.

Holder 10 is a planar sheet 12 from which parallel channels 14 and 15 protrude from one or both sides. Channels 14 have a T-shaped cross section with an upright web 16 and cross bar 18. Grippers 20 may depend from the ends or at intermediate point (not shown) of crossbars 18. Channels 15 or "edge mounts" on the upper edge 21 or lower edge 22 of sheet 12 may have crossbars 19 on only one side of right webs 16. Optionally, upright webs 16 of channels 15 may extend outward by some additional amount to form extensions 24 to provide a stable base upon which holder 10 may be placed standing upright on a display surface, such as a table.

Carpet swatches 26 typically comprise generally a pile layer 28 and backing layer 30. Swatches 26 are held in place on holder 10 by inserting the swatches between channels 14, or 14 and 15, so that the backing layer 30 is adjacent to sheet 12. Sleeves 32 are defined by adjacent channels 14, or 14 and 15. Gripper webs 20 of channels 14 extend into pile layer 28 to hold swatches 26 firmly in place, while still allowing swatches 28 to be easily removed from holder 10. Grippers 20 may extend inwardly enough to contact layer 30 of swatch 28, thereby securely forcing swatch 28 against sheet 12. If grippers 20 are not provided, swatches 26 may move side to side across sheet 12 more freely but are still trapped between crossbars 18 and sheet 12.

Channels 14 may be spaced at any desired interval A on the faces of sheet 12. The variation in distance A will determine the size of swatch 26 which may be inserted into the spaces between channels 14, or 14 and 15. Thus, as shown in FIG. 1, one side of sheet 12 may have three channels 14 and two channels 15, thereby accommodating four sleeves 32 of swatches 26. Two mounts 15 may be placed at the top and bottom edges of the opposite face of sheet 12, thereby allowing only one sleeve 32 of swatches 26, or a single swatch 26, to be placed thereon. The number of channels 14 placed on either face of sheet 12 and the distance A between those channels may be varied to produce any desired aesthetic effect, or density of swatches. As illustrated in FIG. 1, swatches 26 may be cut in narrow strips so that a substantial number of swatches 26 may be inserted into one sleeve 32.

Although the foregoing is provided for purposes of illustrating, explaining and describing certain embodiments of the carpet holder in particular detail, modifications and adaptations to the described holder and other embodiments will be apparent to those skilled in the art and may be made without departing from the scope or spirit of the invention. For instance, end caps may be mounted to cover the left and right edges of holder 10 to prevent swatches from sliding out and to give the edges a more finished appearance. Similarly, multiple holders 10 may be hinged together in a "book" or on a display stand, or may be carried in a case, to provide a means for storing and displaying a very substantial number of carpet samples.

We claim:

1. An apparatus for holding and displaying at least one carpet swatch comprising:

a) a central sheet having a first face and a second face;

b) at least first and second channels protruding from the first face defining a first sleeve so that the at least one carpet swatch may be received in the first sleeve; and c) a gripper protruding from each of the at least first and second channels and oriented perpendicular to the central sheet.

2. The apparatus of claim 1 further comprising at least third and fourth channels protruding from the second face defining a second sleeve so that the at least one carpet swatch may be received in the second sleeve.

3. The apparatus of claim 1 in which the grippers are of a length sufficient to substantially penetrate a pile layer of the at least one carpet swatch.

4. The apparatus of claim 1 in which the first channel is positioned at an edge of the sheet and further comprises an extension affixed to an upright web of the first channel.

5. The apparatus of claim 1 in which the sheet and channels are integrally formed from a single piece of extruded plastic.

6. An apparatus for holding and displaying a plurality of carpet swatches comprising:

a) a central sheet having a first face, a second face, a bottom edge and a top edge;

b) a plurality of intermediate channels attached to the first and second faces in which each of the channels further comprise:

i) an upright web having a proximal end and a distal end in which the proximal end is affixed to the central sheet;

ii) a first crossbar having an intermediate point and first and second edges in which the intermediate point is affixed to the distal end of the central web;

iii) a first gripper affixed to the first edge and oriented perpendicular to the central sheet;

iv) a second gripper affixed to the second edge and oriented perpendicular to the central sheet; and c) first, second, third and fourth edge channels attached to the first and second faces at the bottom and top edges of the central sheet, respectively in which each of the edge channels further comprise:

i) an upright web having a proximal end and a distal end in which the proximal end is affixed to the central sheet;

ii) a crossbar having first and second edges in which first edge is affixed to the distal end of the central web;

iii) a gripper affixed to the second edge and oriented perpendicular to the central sheet.

7. The apparatus of claim 8 further comprising a plurality of extensions in which each extension is affixed to the distal end of the central web of an edge mount.

8. The apparatus of claim 6 in which the sheet and mounts are integrally formed from a single piece of extruded plastic.

9. An extrusion for holding carpet swatches in which the cross-section of the extrusion comprises:

a. a central sheet having a first face, a second face, a bottom edge and a top edge;

b. a plurality of T-shaped intermediate channels protruding from the first and second faces, each of the T-shaped channels having grippers oriented perpendicular to the central sheet; and c. an L-shaped channel protruding from each of the top and bottom edges of the first and second faces, each of the L-shaped channels having grippers oriented perpendicular to the central sheet.

10. The extrusion of claim 9 in which the cross-section of the extrusion further comprises extensions protruding from the L-shaped channels.

11. The extrusion of claim 9 in which the extrusion is plastic.

12. The extrusion of claim 9 in which the extrusion is aluminum.

* * * * *